United States Patent [19]

Gilmore

[11] Patent Number: 4,923,721

[45] Date of Patent: May 8, 1990

[54] MUSICAL ORNAMENT

[75] Inventor: William M. Gilmore, Wanchai, Hong Kong

[73] Assignee: Enesco Imports Corp., Elk Grove Village, Ill.

[21] Appl. No.: 235,317

[22] Filed: Aug. 23, 1988

[51] Int. Cl.[5] ..... A47G 33/08

[52] U.S. Cl. ..... 428/11; 315/185 S; 362/86; 362/806; 428/4; 428/919

[58] Field of Search ..... 315/185 R, 185 S; 428/4, 11, 919; 362/86, 806

[56] References Cited

U.S. PATENT DOCUMENTS

| | | | |
|---|---|---|---|
| 1,781,885 | 11/1930 | Sadacca | 362/392 |
| 2,500,899 | 3/1950 | Leahan | 428/7 X |
| 3,035,162 | 5/1962 | Emmich | 428/11 X |
| 3,233,090 | 2/1966 | Wagner | 40/414 |
| 3,431,409 | 3/1969 | Richter III et al. | 428/11 X |
| 3,694,648 | 9/1972 | Yates | 428/11 X |
| 3,873,880 | 3/1975 | Riddell | 315/185 S X |
| 4,224,364 | 9/1980 | Hunt | 428/11 |
| 4,452,836 | 6/1984 | Daniel, Jr. | 428/11 |
| 4,544,218 | 10/1985 | Sanders et al. | 439/168 |
| 4,682,079 | 7/1987 | Sanders et al. | 315/185 S X |

*Primary Examiner*—Henry F. Epstein

*Attorney, Agent, or Firm*—McAndrews, Held & Malloy, Ltd.

[57] ABSTRACT

A Christmas tree ornament formed of a rectangularly shaped battery box and an ornamentally shaped ornament. The battery box and ornament are interconnected by a flexible cable of two electrical conductors. Visual ornamentation disguises the battery box as a Christmas wrapped give box. The ornament includes a D.C. motor for driving at least one moveable part for performing a decorative visual effect.

9 Claims, 2 Drawing Sheets

21
26
24
25
107
109
111
105
103
115
113
117
35
37
31
33
45
49
101
29
47
39
27
51
56
67
130
55
83
85
89
65
69
73
77
71
61
63
93
97
58
53
75
95
136
135
59
133
57
54
129
131
134
41
23
127
43
125
121
123
17
15
19
13
11

MUSICAL ORNAMENT

BACKGROUND OF THE INVENTION

The invention relates to a Holiday-type ornament or decoration, and more particularly, to a Christmas tree ornament having a DC motor wherein moveable parts create a decorative visual effect.

Heretofore, various types of Christmas tree ornaments provide visual ornamentation by non-moving parts of colored and sparkled designs. These ornaments are not electrically powered but merely provide ornamentation through their static visual appearance. Other ornaments may include some type of illumination for providing light within or on the surface of the ornament to generate a decorative effect. Such illumination is normally provided by power supplied from an AC outlet, however it may be supplied by a DC battery source.

The use of a motor to drive movable parts within or on the surface of an ornament presents the problem of providing sufficient power to the motor for driving of the parts over a long extended period of time. One known solution is to provide A.C. current to the motor through conventional Christmas tree light strings on the tree.

However, the use of conventional AC current requires the use of unsightly wires and often consumes unnecessary electrical energy. Additionally, the large AC voltage presents a shock hazard to person handling the ornaments.

Therefore, it is an objective of the present invention to provide a battery powered ornament of reasonable size for hanging on the limbs of a Christmas tree.

It is another object of the present invention to provide a motor driven Christmas tree ornament without the need for using conventional AC voltage.

It is yet a further objective of the present invention to provide a Christmas tree ornament in which the battery supply is housed separately from the ornament and in which the displeasing visual effects of a battery housing are avoided.

SUMMARY OF THE INVENTION

These and other objects of the invention are achieved in a Christmas tree ornament comprising a pair of separate ornamental units having an elongated flexible cable interconnecting the pair. The first ornamental unit includes a DC motor and at least one movable part for performing a decorative visual effect. The other ornamental unit serves to house the battery supply for developing a DC voltage across the flexible cable to power the DC motor. The battery housing includes ornamental structure for concealing the appearance of the housing as battery supply housing.

DESCRIPTION OF THE PREFERRED EMBODIMENT

Figures 1, 2:
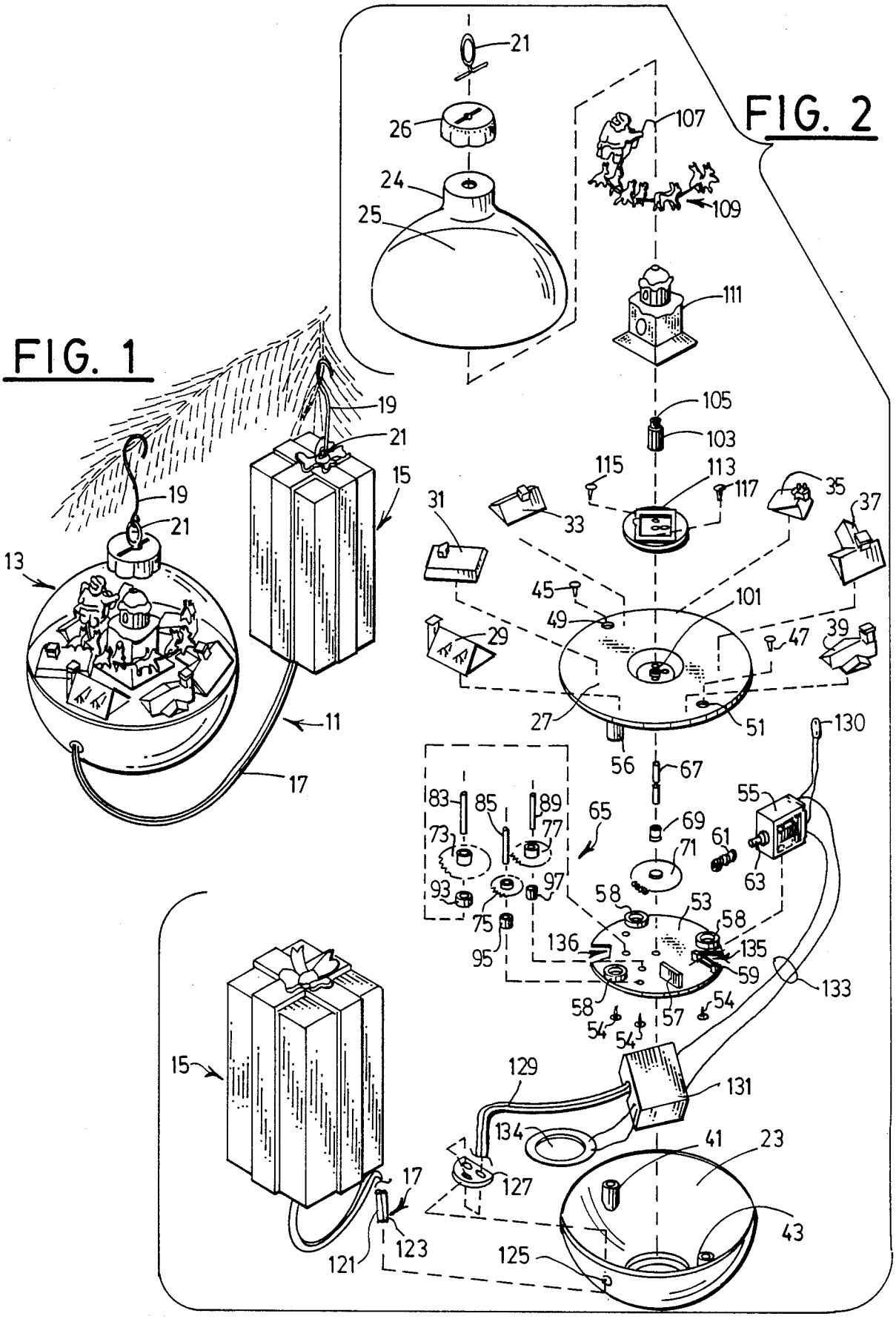
FIG. 1 is a perspective view of a Christmas tree ornament embodiment of the present invention.
FIG. 2 is an exploded perspective view of the Christmas tree ornament of FIG. 1.

Referring to FIG. 1, a Christmas tree ornament is constructed from a pair of separate ornamental units 13,15 which are interconnected by an elongated flexible cable 17. Each one of the separate ornamental unit 13,15 are to be physically spaced apart in separate areas of a Christmas tree. Conventional hooks 19 may be used to hang ornamental units 13,15 from separate tree branches.

Ornamental unit 13 includes a moveable part which is moved in order to form a decorative visual effect. As seen in FIG. 1, a Santa Claus figure and sleigh pulled by eight tiny reindeer moves in a circular pattern above the roofs of houses displayed within ornamental unit 13. Ornamental unit 15 serves as a battery box for housing a battery supply (not shown). The battery supply generates a DC voltage across two wire conductors which form flexible cable 17. The battery box includes visual ornamentation on its outer surface for disguising the battery box as a Christmas-wrapped gift box.

While the two ornamental units 13,15 may be placed in separate areas of a Christmas tree, dependent on the length of cable 17, the two units also may be placed in relatively close proximity. Therefore, the wrapped appearance of ornamental unit 15 is color coordinated with ornamental unit 13.

Both ornamental units 13,15 include an eye hook 21. The eye hook 21 provides a conventional structure for permitting use of conventional tree hooks 19 to hang ornamental units 13,15 from the limbs of a Christmas tree.

Referring to FIG. 2, ornamental unit 13 is generally spherical in shape having a top protuberance 24 shaped to receive a conventional ornamental cap 26. Cap 26 serves to grip the outer surface of protuberance 24 for securing eye hook 21 to ornamental unit 13. Cap 26 also provides a visual Christmas ornament appearance to the spherical unit 13, as seen in FIG. 1.

Ornamental unit 13 includes a lower base portion 23 and an upper top portion 25. Base portion 23 is made from opaque plastic, or the like, concealing from view the electrical components within the base portion. Top portion 25 is made from transparent plastic for revealing the moveable Santa Claus figure, as shown in FIG. 1. The two half portions 23,25 may be secured together by an adhesive to form the spherical ornamental unit 13.

A circular horizontal platform 27 is positioned between the two portions 23,25. Platform 27 serves to conceal the electrical components disposed beneath the platform within base portion 23 as well as provide a support for ornamentation.

A plurality of house roofs 29,31,33,35,37, and 39 are positioned along the outer margin of the top surface of platform 27 as shown in FIG. 1. Each of the roof tops 29–39 are painted in a colorful manner for decorative ornamentation. Roof tops 29–39 are circumferentially spaced on platform 27 to provide an appearance of a skyview looking down on the roofs of homes.

Base portion 23 includes two screw receiving abutments 41, 43 for securing platform 27 in a fixed relationship to base portion 23. Screws 45,47 pass through apertures 49,51 formed in platform 27 and screw into abutments 41,43.

A second platform 53, having a smaller diameter than platform 27, is positioned beneath platform 27 and serves as a support for electrical components. Platform 53 may be glued or otherwise fixed within base portion 23. For example, three screws 54 may be used to secure platform 53 onto three separate legs 56 which depend from platform 27 and which are received by ring members 58. A pair of notches 135,136 are cut in the sides of platform 53 to permit the platform to be positioned over abutments 41,43.

DC motor 55 is secured onto platform 53 between a pair of locating members 57,59. An output shaft 63 of motor 55 is secured to a worm gear 61 for rotational movement with the shaft. Worm gear 61 drives a gear assembly 65 which is supported on platform 53 for rotation of vertical drive shaft 67. Drive shaft 67 passes through an aperture formed in platform 53 and pass through a bearing 69 and a gear 71 for rotational movement as a single unit.

Gears 73,75,77 are intermeshed with each other, with gear 71 and worm gear 61. Gears 73,75,77 rotate on their respective shafts 83,85, 87 which rotate in their respective bearing 93,95,97. Bearings 93,95,97 are secured atop platform 53 and shafts 83,85,87 pass through apertures formed in platform 53 for locating the relative position of the gears 73,75,77.

Gear assembly 65 serves to reduce the rotational speed of output shaft 63 of the motor to a slower rotational speed of drive shaft 67. Drive shaft 67 extends up through a bearing 101 formed at the center of platform 27. An end cap 103 is secured to the end of shaft 67 for rotation therewith. End cap 103 includes an opening 105 formed in the end of the cap for receiving a thin support wire 107 extending from the Santa and eight reindeer component 109.

As shown in FIG. 1 and 2, the Santa and eight reindeer ornamentation traces a generally circular path around a steeple roof 111 as end cap 103 is rotated. Steeple roof 111 is secured to a circular platform 113 which in turn is secured to platform 27 by screws 115,117.

As will suggest itself, shafts 83,85,87 could be utilized to move other visual components on or within ornamental unit 13 in order to create a visual effect. For example, spherical unit 13 could be made to appear as a globe of the earth with Santa Claus, his sleigh and eight reindeer circling the outside of the globe. Instead of a Santa and Sleigh, the moveable part could take the form of a train circling houses or passing through tunnels built on platform 27. Figurines could be placed on platform 27 and the platform 27 itself rotated by power from shaft 67. The ornamental unit 13 could be formed in the shape of a carrousel Merry-Go-Round with a rotating platform. Other shapes of ornament 13 could include, for example, the shape of a piano with moving figures atop the piano's keys. Another ornamentation might take the form of ice skaters skating around a lamp post on an ice-like platform.

Referring again to FIG. 2, cable 17 includes a pair of conductors 121,123 which pass through an opening 125 in base portion 23. Cable 17 is woven through 3 apertures formed in a flat wirelock member 127 which prevents the remaining portion 129 of cable 17 from being pulled through opening 125.

The remaining cable portion 129 is connected to a musical box 31 which generates music when voltage is supplied to the box. A second cable 133 extends between musical box 131 and motor 55 in order to provide DC voltage to motor 55 for powering the same. Notch 135 formed in platform 53 permits cable 133 to pass from beneath platform 53 to the motor.

Musical box 131 is positioned below platform 53 and may be secured to base portion 23 in a conventional fashion. A buzzer 134 may be connected to music box 131 and may be actuated by circuitry housed within box 131 at appropriate times.

As Will suggest itself, music box 131 provides an audible ornamental effect to ornament 11 and may be of a design to provide such effect. For example, music may be generated having a direct bearing on the moving scene or components of the ornament. Additionally, buzzers or other sound makers may be used to provide the ornamental effect. Box 131 may include electrical circuitry to generate the effect and/or to time the effect. Additionally, one or more lamps 130 or other illuminating devices may be used in ornamental unit 13 and may be powered from cable 133.

Figure 3:
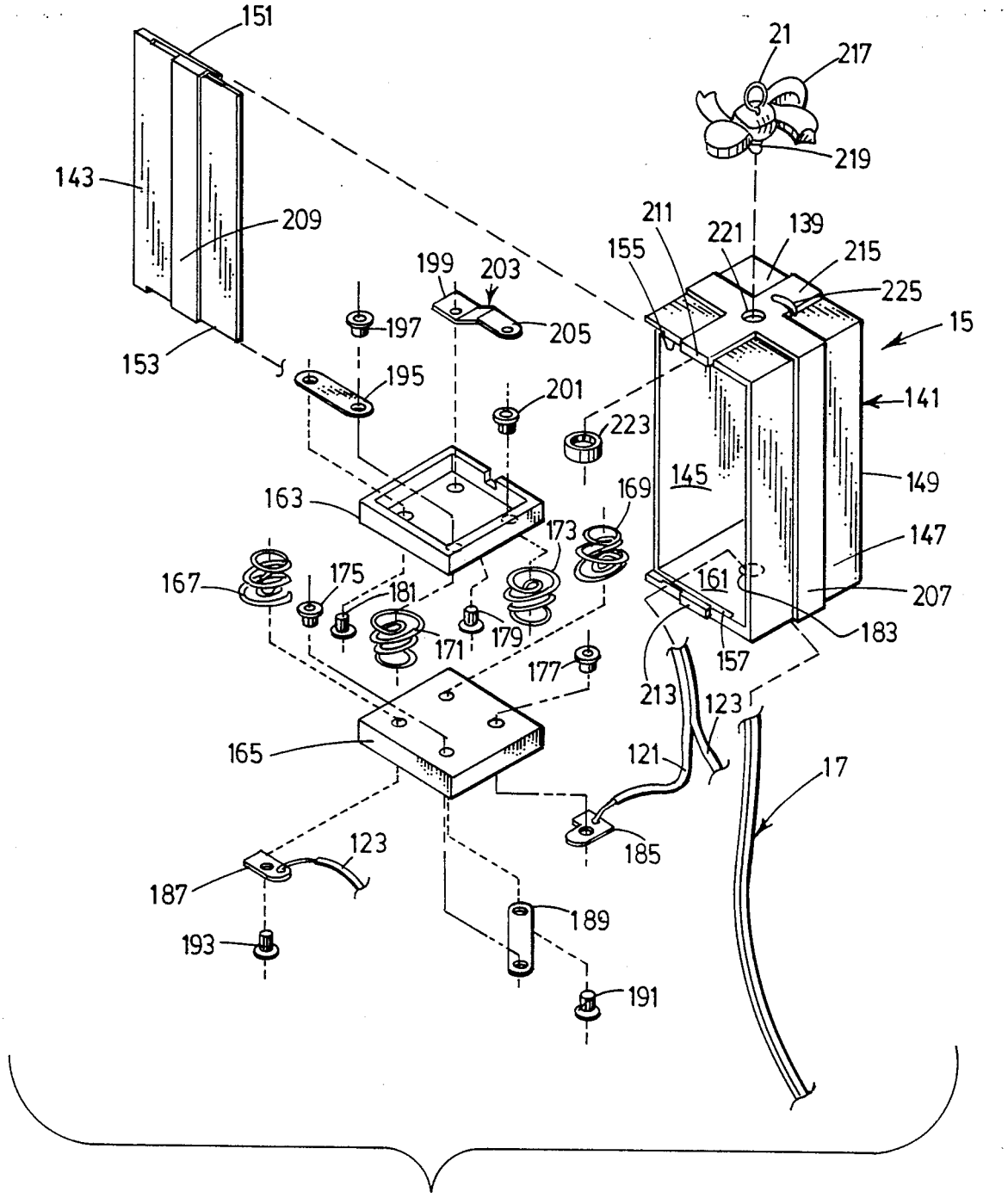
FIG. 3 is an exploded view of the battery box portion of the ornament of FIG. 1.

Referring to FIG. 3, ornamental unit 15 forms a battery box 141 for housing four separate conventional batteries (not shown). Battery box 141 includes four side walls 143, 145, 147 and 149. A substantial portion of side wall 143 serves as a door which is removable from box 141, as shown, to permit replacement and location of batteries. Door 143 includes a relatively thin tongue edge 151 on its top side and a similar relative thin tongue edge 153 (not shown) on its lower side. Edges 151,153 are slidingly received in grooves 155,157 formed in the top wall 159 and the bottom wall 161, respectfully, of battery box 141. Door 143 is slidingly received by grooves 155,157 to permit access to the batteries.

A pair of contact holding members 163, 165 are secured on the inside of top wall 159 and the inside of bottom wall 161, respectively, for providing contact areas between which the batteries are positioned. Four contact springs 167,169,171,173 and four rivet head contacts 175,177,179,181 are secured to members 163,165. Four batteries are positioned in battery box 141 with a contact spring touching one end of a battery and a rivet head contact touching the other end of the battery.

Flexible cable 17 enters an aperture 183 in bottom wall 161 of box 141. Conductor 121 of cable 17 is connected to a contact member 185 and conductor 123 of cable 17 is connected directly to another contact member 187. Contact member 185 is disposed on the underside of member 165 and is held in place by and is electrically connected to rivet head contact 177.

Contact member 187 is disposed on the underside of member 165 and is held in place by an electrically connected to spring 167 by a rivet 193. An elongated contact member 189 is positioned beneath support member 165 for providing an electrical circuit between rivet head contact 175 and contact spring 169. Rivet head contact 175 is connected to one end of contact member 189 and a rivet 191 passes up through the other end of contact member 189 and into electrical connection with spring 169.

Another elongated contact member 195 is electrically connected between rivet head contact 181 and contact spring 171. A rivet 197 passes through an aperture in one of end of contact member 195 for securement to contact spring 171. Rivet head contact 181 passes through an aperture in the other end of contact member 195, riveting the member to the top side of member 163.

A switch contact 199 is also positioned on the top side of holding member 163. Rivet head contact 179 passes through a hole in support member 163 and an aperture in switch contact 199 for electrical connection therewith. A rivet contact terminal 201 is positioned through an aperture in member 163 for securement to and electrical connection with contact spring 173. The electrical contact 199 is bent at 203 to position the outer end 205 at a point spaced above the contact terminal 201. When the contact 205 is pressed downward against terminal 201 voltage from the battery is placed across the two conductors of cable 17.

Battery box 141 includes ribbon structure ornamentation for disguising the appearance of battery box 141 as a Christmas wrapped gift package. The Christmas ribbon structure includes a ribbon stripe 207 on side wall 147, a ribbon stripe 209 on the side wall (door) 143 and a pair of like ribbon stripes (not shown) on side walls 145 and 149. As shown, the stripe 209 on the door 143 extends to two separate stripe portions 211 and 213 positioned on the small portion of the side wall 143 which does not form the door portion. The top wall 159 includes an X-shaped ribbon structure 215.

A bow structure 217 is formed out of plastic and includes a shaft member 219 which passes through an aperture 221 located at the center of the X-shaped stripe 215 and passes into the interior of battery box 141. A bearing member 223 is positioned within the battery box for connection to shaft 219 to permit rotational movement of bow structure 217. A cam lever arm 225 is positioned relative to bow structure 217 for movement into and out of the interior of the battery box in accordance with the rotational position of bow structure 217. As the lever arm 225 moves into the interior of the battery box, the lever arm 225 contacts electrical contact 199 at its end portion 205 serving to press the contact portion 205 against the electrical terminal 201. This effectively switches the battery voltage across the cable 17. Thus, the turning of bow structure 217 serves to turn the power on and off to the DC motor 55.

As will suggest itself other switch mechanisms may be utilized on or within the battery box in order to effectively connect the batteries to cable 17.

What is claimed is:

1. An improved Christmas tree ornament comprising: a separate, rectangularly shaped battery box unit; a separate, holiday - type, generally spherically shaped ornament unit; an elongated flexible cable that has a predetermined length and that is formed of at least two electrical conductors, the flexible cable interconnecting the battery box unit and the ornament unit; the battery box unit having its outer surfaces visually ornamented for disguising the battery box unit as a Christmas wrapped gift box;

first hook means adapted for hanging the battery box unit at a first point within a Christmas tree;

the battery box unit also having: means in one of its outer surfaces for permitting removal and replacement of a battery supply within the battery box unit;

electrical contact means for interconnecting the battery supply stored within the battery box unit to the electrical conductors for developing a D.C. voltage across the electrical conductors; and electrical switch means for selectively activating the electrical contact means so as to interconnect and disconnect the battery supply stored within the battery box unit to the electrical conductors, the electrical switch means being mounted, at least in part, on an outer surface of the battery box unit so that the electrical switch means may be activated from without the battery box unit, with the part of the electrical switch means mounted on the outer surface of the battery box unit having a shape and visual appearance such that it forms an integral part of and blends with the visual ornamentation of the battery box unit;

the ornament unit comprising:

an outer generally spherical shell that is, in part transparent and, in part nontransparent; that has a first interior portion which is disposed within the transparent part of the shell and which is visually decorated with a holiday - type theme; at least one part that is movable along a preselected path within the interior of the shell so as to cooperate with and enhance the first visually decorated portion of the interior of the shell and so as to provide a decorative visual effect;

a D.C. motor being disposed within the nontransparent part of the shell and being connected to the one moveable part for the moving the same, the motor also being electrically connected to the electrical conductors for powering of the motor by said D.C. voltage; and second hook means adapted for hanging the ornament unit at a second point, within the Christmas tree spaced from said first point, with the first and second points being spaced apart a distance less than the predetermined length of the flexible cable.

2. A Christmas tree ornament according to claim 1 wherein the battery box unit includes four side walls, a top wall and a bottom wall disposed in the shape of a rectangular box, wherein said visual means of the battery box unit includes Christmas ribbon appearance structure, wherein the Christmas ribbon appearance structure includes a bow structure disposed on the outer surface of the top wall of the battery box unit; and wherein said bow structure constitutes the part of the electrical switch means mounted on the outer surface of the battery box unit and is manually moveable, relative to the top wall, for actuating the electrical switch means.

3. A Christmas tree ornament according to claim 2 and further including electrical switch means actuatable for switching the D.C. voltage of the battery supply across said pair of conductors and wherein said bow structure is manually moveable relative to said top wall for actuating said electrical switch means.

4. A Christmas tree ornament according to claim 2 wherein said Christmas ribbon appearance structure includes a flat ribbon stripe secured to each of said four side walls and each stripe extending to the top wall, and a flat ribbon x-shape structure disposed on said top wall with each end of each leg of the X-shape structure extending to meet a said stripe.

5. A Christmas tree ornament according to claim 4 and wherein said bow structure is positioned at the center of said X-shaped structure.

6. A Christmas tree ornament according to claim 2 wherein one of the side walls of the battery box unit includes the removable door which is manually openable for permitting removal and replacement of the battery supply within the battery box unit.

7. A Christmas tree ornament according to claim 6 wherein said door includes slidable tongue means and wherein said top wall and said bottom wall includes groove means for slidably receiving said tongue means.

8. A Christmas tree ornament according to claim 2 wherein the ornament unit includes means for generating an audible effect, and wherein said pair of conductors is electrically connected to the audible effect means.

9. A Christmas tree ornament according to claim 8 wherein said audible effect means includes a music box for generating a musical tune.

* * * * *